United States Patent [19]

Hoshino et al.

[11] 4,378,246

[45] Mar. 29, 1983

[54] PRECIPITATION HARDENING TYPE STAINLESS STEEL FOR SPRING

[75] Inventors: Kazuo Hoshino; Sadao Hirotsu, both of Yamaguchi; Masahiro Nishimura; Teruyoshi Iida, both of Tokuyama, all of Japan

[73] Assignee: Nisshin Steel Co., Ltd., Tokyo, Japan

[21] Appl. No.: 244,292

[22] Filed: Mar. 16, 1981

[30] Foreign Application Priority Data

Mar. 19, 1980 [JP] Japan ..... 55-34138

[51] Int. Cl.[3] ..... C22C 38/50

[52] U.S. Cl. ..... 75/125; 75/128 T; 148/37

[58] Field of Search ..... 148/12 E, 37; 75/128 A, 75/128 T

[56] References Cited

U.S. PATENT DOCUMENTS

| | | | |
|---|---|---|---|
| 2,527,521 | 10/1950 | Bloom | 148/37 |
| 3,562,781 | 2/1971 | Tanczyn | 75/128 A |
| 3,917,492 | 11/1975 | Backman | 148/12 E |

FOREIGN PATENT DOCUMENTS

| | | | |
|---|---|---|---|
| 53-57114 | 5/1978 | Japan | 75/128 T |
| 54-120223 | 9/1979 | Japan | 148/12 E |
| 1018674 | 1/1966 | United Kingdom | 75/128 T |

*Primary Examiner*—Peter K. Skiff

*Attorney, Agent, or Firm*—Kane, Dalsimer, Kane, Sullivan and Kurucz

[57] ABSTRACT

Precipitation hardening type stainless steel comprising in % by weight, $0.03<C\leqq0.08$, $0.3\leqq Si\leqq2.5$, $Mn\leqq4.0$, $5.0\leqq Ni\leqq9.0$, $12.0\leqq Cr\leqq17.0$, $0.1\leqq Cu\leqq2.5$, $0.2\leqq Ti\leqq1.0$, and $Al\leqq1.0$, the balance being Fe and impurities, the elements being further adjusted so that $$A'=17\times(C/Ti)+0.70\times(Mn)+1\times(Ni)+0.60\times(Cr)+0.76\times(Cu)-0.63\times(Al)+20.871$$

is less than 42.0, $$\frac{\text{Cr equivalents}}{\text{Ni equivalents}}=\frac{1\times(Cr)+3.5\times(Ti+Al)+1.5\times Si}{1\times(Ni)+0.3\times(Cu)+0.65\times(Mn)}$$

is not more than 2.7, and $$\Delta Hv=205\times[Ti-3\times(C+N)]+205\times[Al-2\times(N)]+57.5\times(Si)+20.5\times(Cu)+20$$

is within the range between 120 and 210, said steel as solution treated and optionally slightly cold worked having a substantial martencite structure. The steel has a good mechanical workability before aging, and when age hardened, it develops improved hardness and toughness as well as an isotropic and improved spring performance.

2 Claims, 11 Drawing Figures

PRECIPITATION HARDENING TYPE STAINLESS STEEL FOR SPRING

BACKGROUND OF THE INVENTION

The present invention relates to a precipitation hardening type stainless steel for spring, which has an excellent processability, including good forming and punching workabilities, because of its reduced level of work hardening when cold worked and, which exhibits, when age-hardened, a high strength and other desirable spring performances which are substantially isotropic.

Illustrative of typical known stainless steel for spring one can mention the following two species:

(a) work hardening type stainless steel represented by SUS 301 steel, and;

(b) precipitation hardening type stainless steel represented by 17-7PH steel.

The work hardening type stainless steel (a) above is based upon the utilization of the hardness of the martensite itself which has been induced by cold working. Accordingly, in order to achieve sufficient properties for a spring material, such as a high spring limit value, high fatigue limit and high hardness, an intensive cold working is required so as to form appreciable amounts of martensite. Because the formation of martensite is adversely affected by high temperatures, the cold working must be carried out at a low rate to avoid an increase of the temperature of the material, leading to a low productivity. Inevitable variations in the compositions from charge to charge results in variations in the stability of the austenite phase, and this fact makes it difficult to form a constant amount of martensite by a constant amount of cold working, leading to variations in the properties of the product. Moreover, the intensive cold working required to achieve the high strength is expensive. In a case wherein an EH material having a hardness of at least Hv 490 as prescribed in JIS G4313 should be prepared a cold working with a rolling reduction of at least 50% is required, and the material so cold worked has a poor forming workability and gives rise to a problem in that when such a material is fabricated to a spring element by punching, the punching tools are unduly worn.

The 17-7PH steel (b) mentioned above is a precipitation hardening type steel and therefore, difficulties as involved is SUS 301 are not encountered in order to achieve a high strength. However, this steel has a structure of a substantial austenite phase, at the state of as having been solution treated, which phase must be converted to a martensite phase by cold working. Accordingly, there are difficulties in the manufacturing process as is the case with SUS 301. Furthermore, in order to achieve a final hardness of at least Hv 490 after being age hardened, a cold working with a rolling reduction of at least 40% is required, and the thus cold worked material has a hardness of at least about Hv 400 exhibiting poor forming and punching workabilities. Moreover, the 17-7PH steel contains an appreciable amount of δ-ferrite due to its relatively high content of Al, and in consequence the yield in the hot working steps is reduced, rendering the manufacturing cost expensive.

As discussed above, the known types of stainless steel for spring suffer from conflicting limitations in that an attempt to achieve an increased final hardness requires an intensive cold rolling, resulting in an unduly high hardness and poor forming and punching workabilities at the state of having been cold worked, while an attempt to improve the forming and punching workabilities of the material as cold worked results in insufficient final hardness after being aged. Furthermore, the attainable final hardness of a spring element made from the known types of stainless steel for spring has been still unsatisfactory in comparison with difficulties involved in the manufacturing process.

We previously developed a stainless steel for spring which has an improved workability and processability when compared with those of SUS 301 and 17-7PH and which exhibits a martensite structure at the state of having been solution treated or at the state of having been solution treated and then slightly cold worked. We proposed such a steel in Japanese Patent Application No. 51-131610, assigned to the same assignee for "Stainless Steel for Spring Having Improved Forming Workability and Processability and Exhibiting Improved Increase in Hardness by Aging" (see Japanese Patent Laid-open Specification No. 53-57114, published on May 24, 1978).

The subject matter of this Japanese Patent Application No. 51-131610 is a stainless steel comprising, in % by weight, not more than 0.03% of C, 0.5 to 2.5% of Si, not more than 3.0% of Mn, 5.0 to 9.0% of Ni, 14.0 to 17.0% of Cr, 0.5 to 2.5% of Cu, 0.3 to 1.0% of Ti, not more than than 1.0% of Al and not more than 0.03% of Ni, the balance being Fe and unavoidable impurities, the contents of Mn, Ni, Cr, Cu, Si, Ti and Al being further adjusted so that the value of A defined by the equation (i):

$$A=0.70\times(Mn\%)+1\times(Ni\%)+0.60\times(Cu\%)+0.76\times(Cu\%)-0.63\times(Al\%)+20.871 \quad \text{(i)}$$

is less than 39.0, the value of Cr equivalents/Ni equivalents defined by the equation (ii);

$$\frac{\text{Cr equivalents}}{\text{Ni equivalents}} = \frac{1\times(Cr\ \%)+3.5(Ti\ \%+Al\ \%)+1.5(Si\ \%)}{1\times(Ni\ \%)+0.3(Cu\ \%)+0.65\times(Mn\ \%)} \quad \text{(ii)}$$

is not more than 2.7, and the value of H defined by the equation (iii):

$$H=4\times[(Ti\%)-5\times(C\%+N\%)]+4\times[(Al\%)-3\times(N\%)]+2.8\times(Si\%)+1\times(Cu\%) \quad \text{(iii)}$$

is within the range between 5.5 to 8.5. We further found that the material having the elements adjusted in the manner as described above may be cold worked with a rolling reduction of 5 to 50% prior to the age hardening step so that a good forming workability and an enhanced ability of being age hardened as well as a good elongation after age hardened may be achieved. The process was proposed in Japanese Patent Application No. 51-131611, assigned to the assignee of this application, for "Process for Producing Stainless Steel for Spring Having Improved Forming Workability and Toughness and Exhibiting Enhanced Ability of Being Age Hardened" (see Japanese Patent Laid-open Specification No. 53-57115, published on May 24, 1978). The inventions claimed and disclosed in the above-mentioned Japanese Patent Applications make much account of the forming workability before aging as well as the strength and toughness after aging, and respectively relate to a stainless steel for spring exhibiting an enhanced ability of being age hardened and a process for the production of such a stainless steel for spring. The steel has a martensite structure, and therefore, not to detract from its workability the carbon content is held at a low level.

Leaf spring elements, including snap rings, bellevills springs, spring washers, toothed washers and the like, are generally fabricated by punching suitable materials. Accordingly, the material for such spring elements should have a moderately reduced hardness before aging. Since the punched piece is frequently formed into the final element by bending, the material for spring should also possess a good forming workability. Furthermore, it is widely practiced to form a thin material for spring into various shapes of a small size by bulging, drawing and/or bending thereby to manufacture a miniaturized spring element whose reduced durability and strength are compensated by its shape. Again, a good forming workability is required here. On the other hand, the material for spring should possess a high strength and other enhanced spring characteristics after aging. As to these requirements the spring material described in Japanese Patent Application No. 51-131610 is fairly satisfactory. Nevertheless, a further improvement is still desired.

SUMMARY OF THE INVENTION

An object of the invention is to provide an improvement to the known stainless steel for spring of a type described in Japanese Patent Application No. 51-131610.

As a result of extensive investigations of this type of stainless steel for spring, it has now been found that the toughness of the age-hardened material depends upon the hardness differential ΔHv, that is the difference between the hardnesses before and after aging rather than the hardness after aging. We have also found that as the hardness differential ΔHv exceeds 210, the toughness of the age hardened material begins to decrease. Thus, in order to achieve improved strength and toughness after aging, it would be advantageous to suitably balance the alloying elements so that an appropriate hardness may be realized before aging. In other words, the intended stainless steel for spring, which exhibits improved strength and toughness after aging, should, at the state of having been solution treated or at the state of having been solution treated and then slightly cold worked, preferably possess a hardness higher than that possessed by the as solution treated stainless steel described in Japanese Patent Application No. 51-131610.

Thus, the invention provides a precipitation hardening type stainless steel for spring comprising in % by weight more than 0.03% but not more than 0.08% of C, 0.3 to 2.5% of Si, not more than 4.0% of Mn, 5.0 to 9.0% of Ni, 12.0 to 17.0% of Cr, 0.1 to 2.5% of Cu, 0.2 to 1.0% of Ti and not more than 1.0% of Al, the balance being Fe and unavoidable impurities, the contents of the elements being further adjusted so that the A′ value defined by the equation $$A' = 17\times(C\%/Ti\%)+0.70\times(Mn\%)+1\times(Ni\%)+0.60\times(Cr\%)+0.76\times(Cu\%)-0.63\times(Al\%)+20.871$$

is less than 42.0, the ratio of Cr equivalents to Ni equivalents defined by the equation $$\frac{\text{Cr equivalents}}{\text{Ni equivalents}} =$$

-continued $$\frac{1\times(Cr\%)+3.5\times(Ti\%+Al\%)+1.5\times(Si\%)}{1\times(Ni\%)+0.3\times(Cu\%)+0.65\times(Mn\%)}$$

is not more than 2.7, and ΔHv value defined by the equation $$\Delta Hv = 205\times[Ti\%-3\times(C\%+N\%)]+205\times[Al\%-2\times(N\%)]+57.5\times(Si\%)+20.5\times(Cu\%)+20$$

is within the range between 120 and 210, said steel having a substantial matensitic structure at the state of having been solution treated or at the state of having been solution treated and then cold worked with a rolling reduction of not more than 50%.

DETAILED DESCRIPTION OF THE INVENTION

Figure 1:
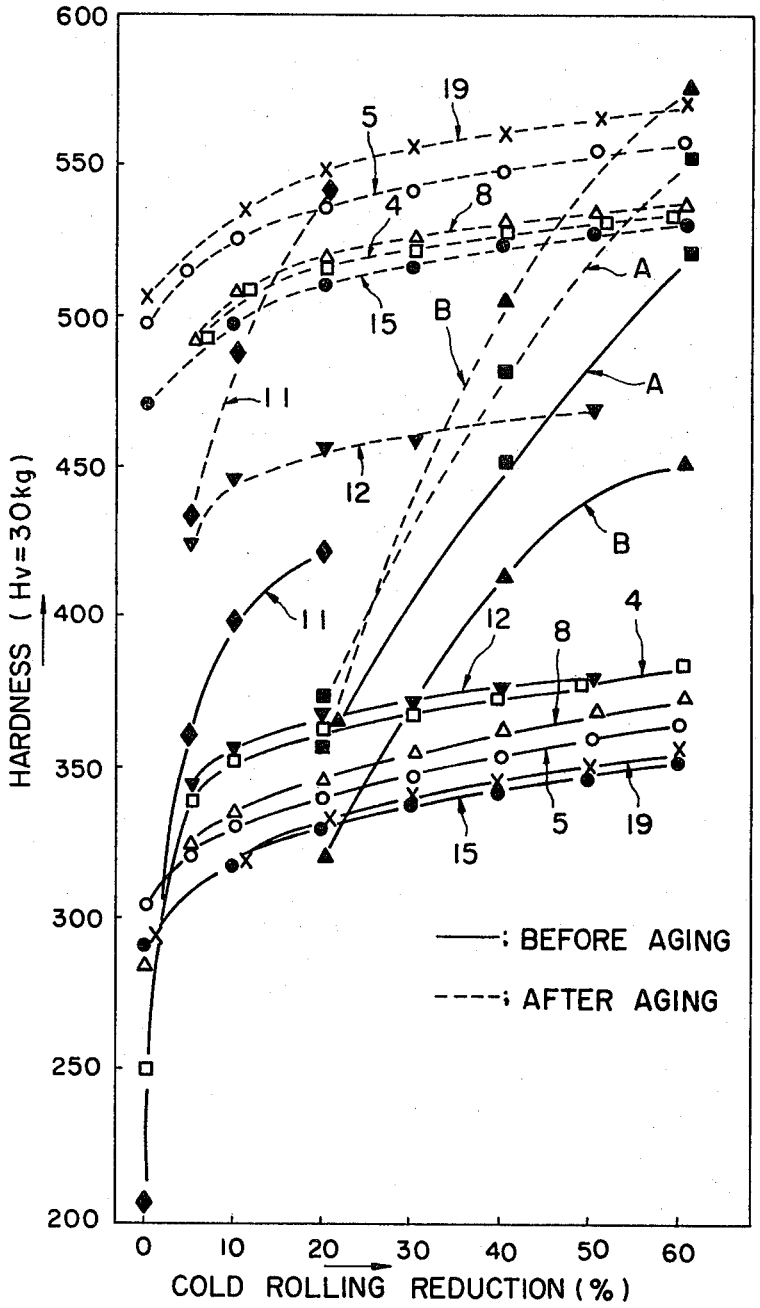
FIG. 1 is a graphical representation showing, on various steel alloy specimens, the dependency of the hardness (both before and after aging) upon the cold rolling reduction.

Because an object of the invention is to provide an improvement to the known stainless steel for spring of a type described in Japanese Patent Application No. 51-131610, the stainless steel according to the invention has a chemical composition somewhat different from that of the stainless steel described in Japanese Patent Application No. 51-131610. The criticality or technical significance of the chemical composition possessed by the stainless steel in accordance with the invention will now be described.

Re 0.03% < C ≦ 0.08%

Japanese Patent Application No. 51-131610 makes much account of the forming workability and prescribes that the carbon content of the stainless steel should be not more than 0.03% by weight. As already stated, however, the invention is based on a discovery that for the precipitation hardening type stainless steel concerned the toughness of the material after aging depends upon the hardness differential, ΔHv, (the difference between the hardness after aging and the hardness before aging) rather than the hardness after aging. In order to achieve improved strength and toughness after aging it would be advantageous to realize an appropriate level of hardness before aging. For this purpose it is desirable to realize a slightly increased hardness of the material as solution treated and to utilize work hardening of a slight amount of a retained austenite phase. From such reasoning, more than 0.03% by weight of C has been set. On the other hand an excessive amount of C tends to result in a harder martensite phase in the matrix and a higher level of C dissolved in the retained austenite phase, both leading to an impairment of the cold workability of the steel. Moreover, a high carbon steel as cold worked has an unduly increased hardness and in turn poor forming and punching workabilities. Furthermore, an increased amount of Ti is required for the stabilization of an excessive amount of C. For these reasons, the upper limit of C has been set as at most 0.08% by weight.

Re N ≦ 0.03%

N has a great affinity to the precipitation hardening element, Ti. If the content of N is too high, relatively large inclusions of TiN are formed in the material, leading to an appreciable reduction in the ultimate toughness of the material. Furthermore, an excessive amount of N unduly reduces an effective amount of Ti. For these reasons, N has been controlled at a level not more than 0.03% by weight.

Re 0.3% ≦ Si ≦ 2.5%

Japanese Patent Application No. 51-131610 prescribes from 0.5 to 2.5% by weight of Si. According to Japanese Patent Application No. 51-131610 the carbon content is not more than 0.03% by weight and therefore the strength of the matrix is low. Accordingly, in order to achieve a high strength after quench aging at least 0.5% by weight of Si is required. Whereas according to the invention the base can be harder partly because the matrix is stronger owing to the presence of more than 0.03% by weight of C and partly because work hardening of a certain amount of retained austemite may be utilized, and therefore, it is possible to achieve considerable levels of properties of the material even if the precipitation hardening effect of Si is slight. For this reason the lower limit of Si has been broadened to 0.3% by weight. On the other hand, the upper limit of Si has been set as at most 2.5% by weight. This is because substantially no additional beneficial effect is observed even if Si is added in excess of 2.5% by weight. Rather, the addition of an excessive amount of Si promotes the formation of a δ-ferrite phase.

Re 0.1% ≦ Cu ≦ 2.5%

As is the case with Si, it is not necessary to make much account of the precipitation hardening effect of Cu in order to achieve satisfactory properties of the stainless steel. For this reason the lower limit of Cu has been broadened to 0.1% by weight. On the other hand even if an additional amount of Cu is added in excess of 2.5% by weight, the effect of the addition is not appreciably increased in proportion to the additional amount.

Re 0.2% ≦ Ti ≦ 1.0%

Ti is one of the elements which develop the precipitation hardening. For an effective precipitation hardening, at least 0.2% by weight of Ti is required. On the other hand, the addition of Ti in excess of 1.0% by weight results in an appreciable reduction in the toughness.

Re 5.0% ≦ Ni ≦ 9.0%

Ni is an element which suppresses the formation of δ-ferrite. While the amount of Ni to be added depends upon the amount of Cr to some extent, at least 5.0% by weight of Ni must be used. With Ni less than 5.0% by weight the precipitation hardening tends to be adversely affected. On the other hand, an excessive amount of Ni results in the formation of appreciable amounts of retained austenite. For this reason, the upper limit of Ni has been set as at most 9.0% by weight.

Re 12.0% ≦ Cr ≦ 17.0%

At least 12.0% by weight of Cr is necessary to provide the corrosion resistance inherent to stainless steel. On the other hand, if an excessive amount of Cr is added, unduly excessive amounts of δ-ferrite and retained austenite are formed. For this reason, we use up to 17.0% by weight of Cr.

Re Al ≦ 1.0%

Al may be used as a precipitation hardening element and Ti may be partially replaced with Al. In relation with the toughness, the upper limit of Al has been set as at most 1.0% by weight.

Re Mn ≦ 4.0%

As Ni does, Mn contributes to suppression of the formation of δ-ferrite, and therefore, Mn may be substituted for a part of Ni. Up to 4.0% by weight of Mn may be used in consideration of its effect of suppressing δ-ferrite as well as of the balance of the components relating to the formation of retained austenite.

Re A' value < 42.0

The components, C, Ti, Mn, Ni, Cr, Cu and Al must be adjusted so that the amount of each component falls within each range specified above. They must also be adjusted so that the A' value, as calculated in accordance with the equation (1) defined above, is less than 42.0. The relation between this A' value and A value, which is used in Japanese Patent Application No.

51-131610 as a measure indicating an austenite stability, is as follows.

$$A' = 17\,(C\%/Ti\%) + A$$

It will be noted that we are additionally considering the effect of C and Ti, which is neglected in Japanese Patent Application No. 51-131610. The stainless steel of Japanese Patent Application 51-131610 is a low carbon steel containing not more than 0.03% by weight of C'. It contains an extremely low amount of dissolved C, and therefore, the effect of dissolved C may be neglected. Whereas in the case of stainless steel containing C in excess of 0.03%, the effect of dissolved C cannot be neglected. It has been experimentally found that if the A' value exceeds 42.0, considerable amounts of austenite are retained in the material as solution treated, and an intensive cold working is required to convert such austenite into martensite.

$$Re(Cr\ equ./Ni\ equ.) \leqq 2.7$$

If Cr equivalents/Ni equivalents, as calculated in accordance with the equation (2) defined above, substantially exceeds 2.7, large amounts of δ-ferrite tend to be formed at the soaking temperature, leading to impair the hot workability. In order to achieve an excellent hot workability comparable with that of SUS 304, it is necessary to control Cr equivalents/Ni equivalents at a level not more than 2.7.

$$Re\ 120 \leqq \Delta Hv\ value \leqq 210$$

Figure 2:
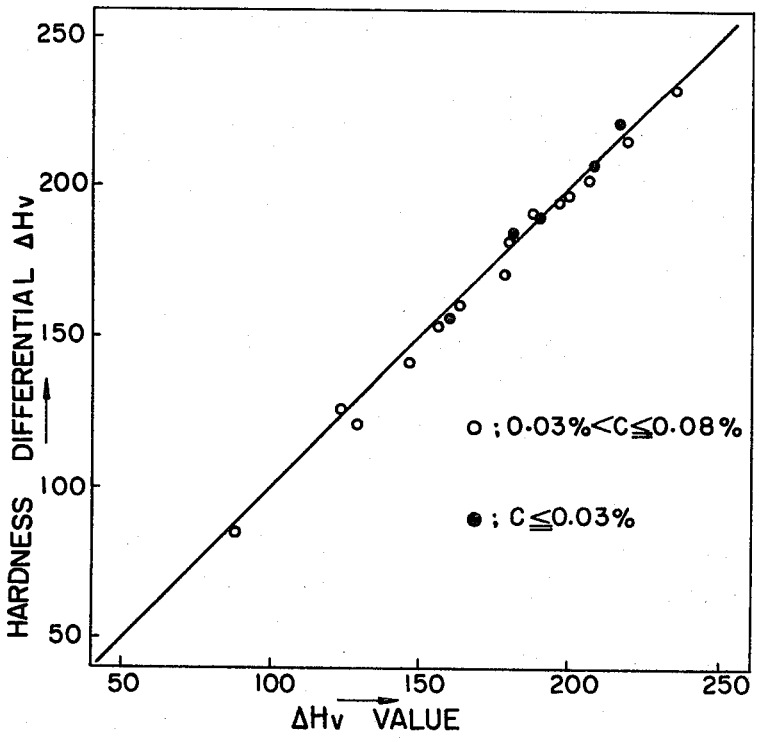
FIG. 2 is a graph obtained by plotting the found hardness differential (hardness after aging-hardness before aging) against the calculated ΔHv value on various steel alloy specimens.
Figure 3:
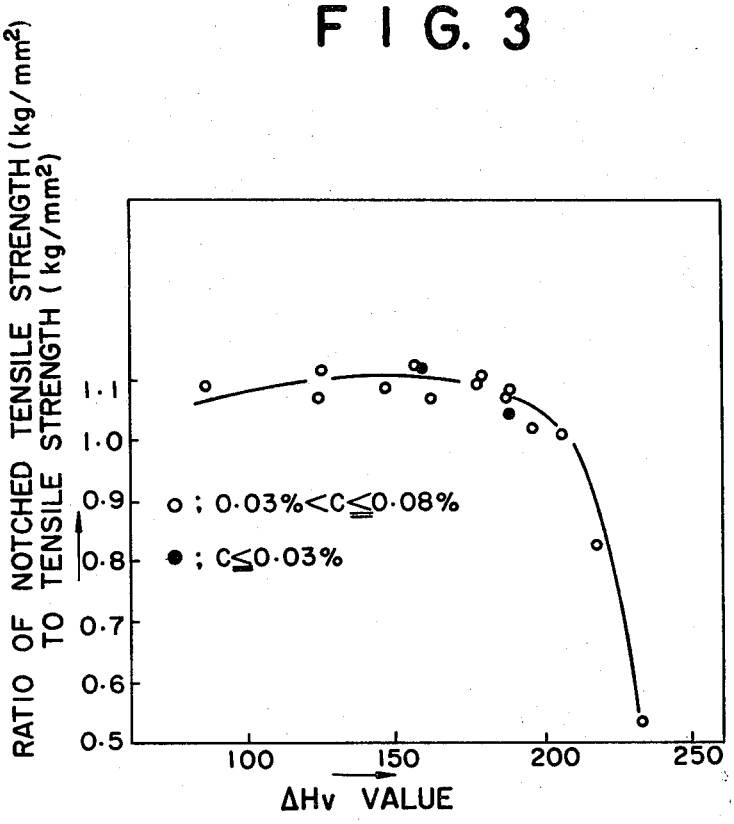
FIG. 3 is a graph obtained by plotting the notched tensile strength ratio (notched tensile strength/tensile strength) after aging against the calculated ΔHv value on various steel alloy specimens.
Figure 4:
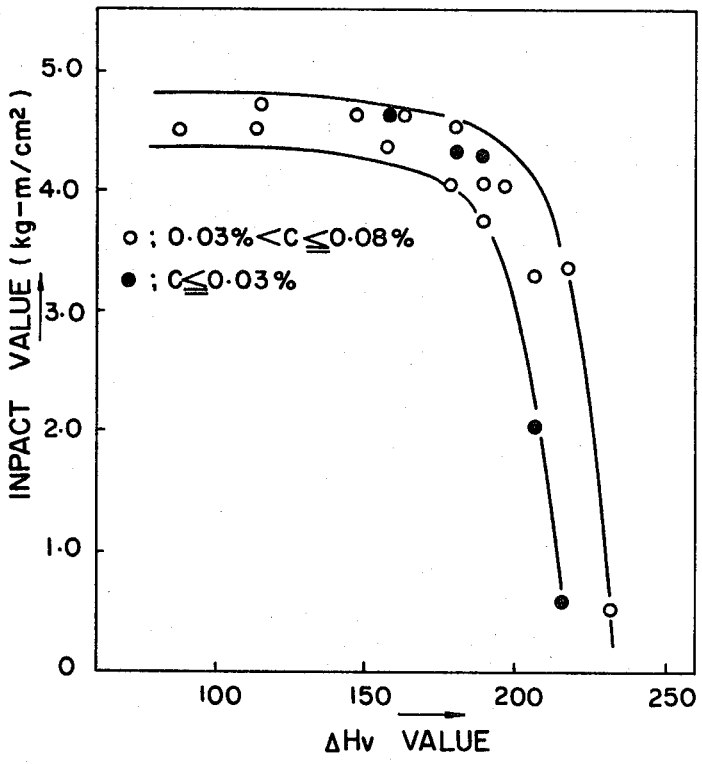
FIG. 4 is a graph obtained by plotting the impact value after aging against the calculated ΔHv value on various steel alloy specimens.

The precipitation hardening elements, Ti,Si, Cu and Al, which contribute to an increase in hardness by aging, must be further adjusted so that the ΔHv value, as calculated in accordance with the equation (3) defined above, falls within the range between 120 and 210. As shown in FIG. 2, the calculated ΔHv value indicates the hardness differential, that is the actual increase in hardness by aging. If the ΔHv value is less than 120, it is generally difficult to achieve a satisfactory hardness and high strength after aging. In order to achieve a high strength with a ΔHv value less than 120, it is necessary to prepare a material which is considerably hard at the state of having been solution treated or at the state of having been solution treated and cold worked. Such a hard material has a poor mechanical workability. On the other hand, as shown in FIGS. 3 and 4, as the ΔHv value exceeds 210, the toughness becomes poor.

The stainless steel having the above-specified chemical composition in accordance with the invention has a substantial martensitic structure at the state of having been solution treated or at the state of having been solution treated and then cold worked with a rolling reduction of not more than 50%.

The stainless steel in accordance with the invention can be prepared by a process known per se. For example it may be prepared as follows.

A steel ingot having the chemical composition specified above is prepared in the usual manner. After soaked at a temperature of 1260° C. the ingot is bloomed to prepare slabs. The slab is heated at a temperature of 1180° C. and hot worked to a hot rolled strip having a thickness of 5.0 mm. After solution treated at a temperature of 900° to 1050° C., the strip is then repeatedly subjected to to a cycle comprising a cold rolling with a reduction of up to 95% and a stress relief annealing at a temperature of 900° to 1050° C. until the desired thickness is reached. The sheet or strip leaving the last step of stress relief annealing is referred to herein as the material as solution treated. The material as solution treated may be conditioned by cold rolling with a reduction of not more than 50%. If a rolling reduction in excess of 50% is used the mechanical workability of the material, that is the ability of being worked by bending, drawing, bulging and other mechanical working, becomes poor.

The invention will be further described by the following comparative tests.

Table 1 indicates the composition in % by weight, A' value, Cr equivalents/Ni equivalents, and ΔHv value, of tested steel alloy specimens. Among the tested steel alloy specimens, specimens No. 1 through No. 10 are in accordance with the invention, while specimens No. 11 through No. 19 as well as specimens A and B are controls outside the scope of the invention. Specimens No. 15 through No. 19 are in accordance with Japanese Patent Application No. 51-131610, while specimens A and B are SUS 301 and 17-7 PH, respectively.

TABLE 1

| | Specimen No. | C | Si | Mn | Ni | Cr | Cu | Ti | Al | N | A' value | Cr equ. / Ni equ. | ΔHv Value |
|---|---|---|---|---|---|---|---|---|---|---|---|---|---|
| According to the Invention | 1 | 0.033 | 1.45 | 0.31 | 7.40 | 14.90 | 1.00 | 0.34 | 0.020 | 0.015 | 39.83 | 2.32 | 162 |
| | 2 | 0.047 | 0.65 | 1.00 | 6.70 | 14.50 | 0.51 | 0.32 | 0.45 | 0.009 | 39.57 | 2.42 | 188 |
| | 3 | 0.034 | 1.52 | 0.29 | 7.01 | 14.77 | 0.61 | 0.28 | 0.025 | 0.015 | 39.46 | 2.45 | 146 |
| | 4 | 0.048 | 1.51 | 0.30 | 7.10 | 14.52 | 1.70 | 0.26 | 0.018 | 0.013 | 41.31 | 2.28 | 156 |
| | 5 | 0.032 | 1.53 | 0.31 | 7.07 | 14.55 | 0.51 | 0.49 | 0.030 | 0.010 | 38.37 | 2.51 | 195 |
| | 6 | 0.044 | 1.53 | 0.30 | 7.21 | 14.70 | 0.70 | 0.43 | 0.020 | 0.008 | 39.37 | 2.44 | 179 |
| | 7 | 0.045 | 0.34 | 2.50 | 6.21 | 14.50 | 0.30 | 0.95 | 0.021 | 0.012 | 38.55 | 2.32 | 205 |
| | 8 | 0.064 | 1.55 | 0.30 | 7.10 | 14.75 | 0.90 | 0.47 | 0.024 | 0.012 | 40.01 | 2.49 | 177 |
| | 9 | 0.065 | 1.45 | 0.29 | 6.71 | 14.58 | 0.62 | 0.26 | 0.022 | 0.011 | 41.24 | 2.50 | 123 |
| | 10 | 0.034 | 1.49 | 0.32 | 7.45 | 15.05 | 1.30 | 0.41 | 0.020 | 0.012 | 39.96 | 2.33 | 187 |
| Control | 11 | 0.075 | 1.53 | 0.52 | 7.70 | 15.00 | 0.50 | 0.29 | 0.024 | 0.012 | 42.70 | 2.25 | 124 |
| | 12 | 0.063 | 0.96 | 0.32 | 6.50 | 14.43 | 0.52 | 0.22 | 0.018 | 0.009 | 41.51 | 2.43 | 87 |
| | 13 | 0.035 | 1.50 | 0.32 | 7.10 | 14.70 | 0.55 | 0.70 | 0.024 | 0.012 | 38.27 | 2.61 | 232 |
| | 14 | 0.036 | 1.49 | 0.32 | 7.44 | 14.94 | 1.08 | 0.57 | 0.020 | 0.009 | 39.38 | 2.41 | 217 |
| | 15 | 0.010 | 1.54 | 0.33 | 7.51 | 14.81 | 1.09 | 0.31 | 0.028 | 0.014 | 38.86 | 2.27 | 180 |
| | 16 | 0.006 | 1.59 | 0.35 | 7.66 | 14.89 | 0.95 | 0.41 | 0.028 | 0.013 | 38.66 | 2.30 | 204 |
| | 17 | 0.010 | 1.08 | 0.28 | 7.63 | 15.03 | 1.07 | 0.33 | 0.020 | 0.010 | 39.03 | 2.20 | 159 |
| | 18 | 0.007 | 1.55 | 0.32 | 7.49 | 14.93 | 1.08 | 0.36 | 0.026 | 0.018 | 38.68 | 2.32 | 188 |
| | 19 | 0.010 | 1.54 | 0.30 | 7.30 | 14.97 | 1.05 | 0.48 | 0.021 | 0.011 | 38.50 | 2.44 | 215 |
| | A(SUS301) | 0.096 | 0.51 | 1.04 | 6.96 | 16.72 | 0.06 | — | 0.020 | 0.010 | not calc'd | not calc'd | not calc'd |
| | B(17-7PH) | 0.071 | 0.44 | 0.51 | 7.24 | 16.73 | 0.08 | 0.09 | 1.18 | 0.021 | not calc'd | not calc'd | not calc'd |

On the specimens No. 4,5 and 8 in accordance with the invention as well as the control specimens No. 11, 12, 15, 19, A and B, the dependency of the Vickers hardness upon the cold rolling reduction is graphically shown in FIG. 1, in which the hardness before aging and the hardness after aging are shown by solid and broken lines, respectively. The age hardening was carried out for 1 hour at a temperature of 480° C. for the specimens No. 4,5,8,11,12,15 and 19, 400° C. for the specimen A, or 475° C. for the specimen B.

FIG. 1 reveals that the steel alloy specimens in accordance with the invention exhibit the cold work hardening effect to a reduced extent. The hardness before aging of the specimens in accordance with the invention is less than Hv 380. It will be appreciated that before aging the stainless steel in accordance with the invention can be easily formed into various shapes by mechanical working such as punching, bending, drawing and bulging.

The specimen No. 5 having the lowest A' value of 38.36 among the tested specimens according to the invention, had a substantially martensitic structure at the state of just having been solution treated and thus, exhibited a satisfactory strength at that state. FIG. 1 reveals that such a material as solution treated can be age hardened to exhibit a satisfactory hardness of above 490 Hv. With spesimens No. 4 and 8 having higher A' values, the material as solution treated may be cold worked with a rolling reduction of 5% or more and then age hardened to achieve a satisfactory hardness of above 490 Hv.

FIG. 1 further reveals that with the control specimen A, a hardness of above 490 Hv can only be achieved by aging a cold worked material having a hardness in excess of Hv 450. Obviously, such a hard material has a poor mechanical workability. With the control specimen B, a satisfactory hardness after aging may be achieved starting from a cold worked material having a lower hardness than is required with the specimen A. Nevertheless, the hardness before aging required with the specimen B for the purposed of achieving a satisfactory hardness after aging is still much higher than the hardness before aging possessed by the specimens in accordance with the invention. Furthermore, with the control specimens A and B, the hardness after aging greatly depends upon the rolling reduction with which the material is cold worked. This fact is disadvantageous because the manufacturing process should always be carried out in consideration of both the intended final thickness and hardness. The stainless steel in accordance with the invention does not suffer from such a disadvantage because the hardness after aging does not greatly depend upon the cold rolling reduction with which the material may be conditioned. An additional advantage of the invention may be enjoyed when a thin material for spring is to be manufactured. Because of a reduced extent of the cold work hardening effect of the stainless steel in accordance with the invention, the number of steps of intermediate annealing required in the production of a thin material can be advantageously reduced.

The specimens No. 15 and 19 are in accordance with Japanese Patent Application No. 51-131610. Because an enchanced forming workability after cold working has been intended in Japanese Patent Application No. 51-131610, these specimens have a satisfactorily low hardness at the state of having been cold worked.

The control specimen No. 11 has an A' value in excess of 42.0. Such a stainless steel contains unduly large amounts of retained austenite, and especially when the carbon content is relatively high, the hardness of the material is drastically increased by cold working as is the case with SUS 301 and 17-7PB. The specimen No. 11 exhibits a hardness as high as Hv 400 or more at the state of having been cold worked with a reduction of 10 to 20%. Such a hard material has a poor mechanical workability.

The control specimen No. 12 has a ΔHv value of 87, which is substantially lower than the lowest acceptable ΔHv value of 120. FIG. 1 reveals that with such a stainless steel a satisfactory level of hardness after aging cannot be attained.

On the specimens No. 1 through 19, the hardness differential that is the difference between the hardness after aging and the hardness before aging was plotted against the ΔHv value calculated in accordance with the equation (3) defined above. The results are shown in FIG. 2. The measurement of the hardness differential was carried out on samples at least 80% by weight of which was composed of a martensitic structure. As revealed from FIG. 2, the calculated ΔHv value substantially coincides with the experimentally found increase in hardness caused by aging. The stainless steel in accordance with the invention should preferably have a hardness not more than Hv 380 in order to ensure the desired mechanical workability. For such a steel the ΔHv value calculated in accordance with the equation (3) should be at least 120, or otherwise a satisfactory hardness after aging cannot be achieved.

On the specimens No. 1 through 14,17 and 18, the ratio of the notched tensile strength after aging to the tensile strength after aging was plotted against the calculated ΔHv value. The results are shown in FIG. 3. The notched tensile strength was determined using a test piece with R having a parallel portion of 30 mm in length and 10 mm in width. At the center of the parallel portion a slit of 0.18 mm in width and 1.5 mm in depth was formed on each side by a discharge technique. Such a notched test piece was aged and then used in the test. As revealed from FIG. 3, the toughness of the aged material represented by the ratio of the notched tensile strength to the tensile strength begins to decrease drastically as the ΔHv value exceeds 210.

On the specimens No. 1 through 19, a Charpy impact test was carried out. The test piece was a plate having a width of 15 mm, a length of 80 mm and a thickness of 1.0 mm. At the center of the plate length a V-shaved notch having a tip radius of 0.25 mm, an angle of 45° and a depth of 2 mm was formed on each side. Such a notched test piece was aged and then used in the test. The test was carried out using a 5 Kg-m Charpy impact testing machine by applying a bending impact to the test piece mounted on the machine. The impact energy required to break the test piece was measured. The value so measured was divided by the effective cross-sectional area of the test piece. The value so calculated is referred to herein as an impact value. On the specimens No. 1 through 19, the impact value was plotted against the ΔHv value. The results are shown in FIG. 4. It is revealed from FIG. 4 that the toughness of the aged material represented by the impact value begins to decrease drastically as the ΔHv value approaches and exceeds 210.

Figure 5:
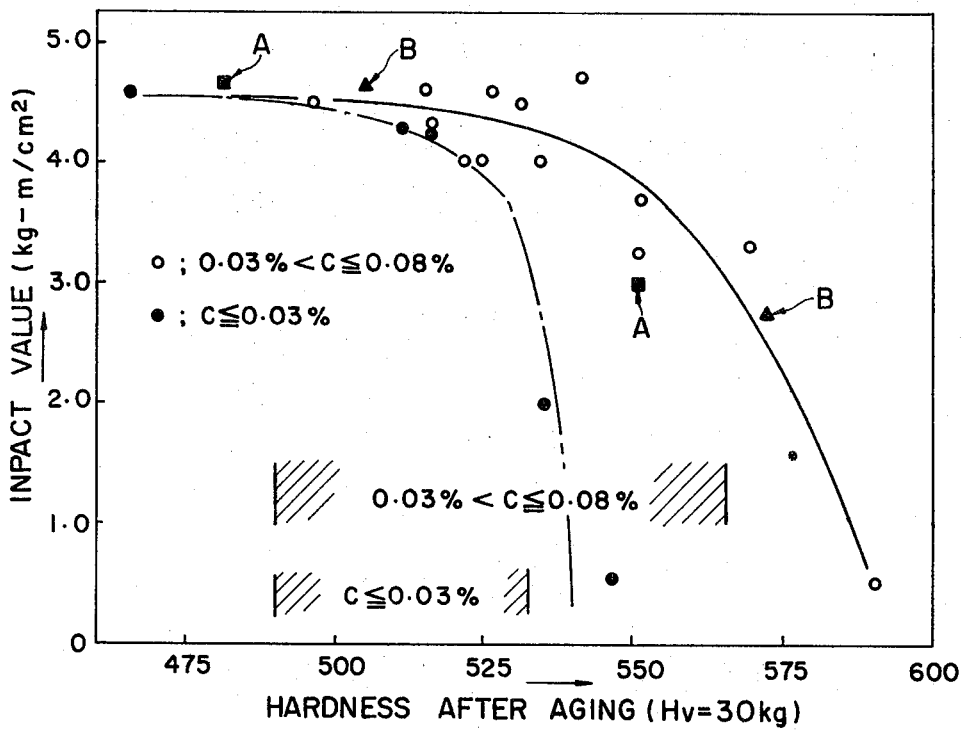
FIG. 5 is a graph obtained by plotting the impact value after aging against the hardness after aging on various steel alloy specimens.

On the specimens No. 1 through 11, and 13 through 19, the impact value was plotted against the hardness after aging. The results are shown in FIG. 5. It is revealed from FIGS. 4 and 5 that for the stainless steel of the type being discussed (that is the precipitation hardening type), the toughness of the aged material as represented by the impact value, depends upon the difference between the hardness after aging and the hardness before aging, instead of the hardness level after aging.

In FIG. 5 the four black circles relate to the control specimens No. 15,16,17 and 19 which are in accordance with Japanese Patent Application No. 51-131610. It is revealed from FIG. 5 that in the area where the hardness of the aged material is higher than Hv 530, the toughness, (impact value) of the stainless steel according to the invention is superior to that of the control steel according to Japanese Patent Application No. 51-131610.

Stainless steel for spring should preferably have an impact value of at least 3 Kg-m/cm$^2$ and a hardness of at least Hv 490 after aging. The range within which these two requirements are met is shown in FIG. 5 by hatching for each of the stainless steel according to the invention and the stainless steel according to Japanese Patent Application No. 51-131610. As seen from FIG. 5, the range within which the two requirements are met is broader for the steel according to the invention than for the steel according to Japanese Patent Application No. 51-131610. The fact that the above-mentioned range is broader means that variations in the $\Delta$Hv value, caused by variation in amounts of the components used, may be tolerated to a greater extent, ensuring a more stable commercial production. By way of an example, in the production of the stainless steel according to Japanese Patent Application No. 51-131610, the content of Ti must be adjusted at the intended value with an allowance of $\pm$0.1%. Whereas in the production the stainless steel according to the invention, variations in the Ti content within the range of $\pm$0.18% can be tolerated.

FIG. 5 further shows test results on the control steel specimens A and B. For each steel specimen two test specimens were prepared. One had been cold rolled with a reduction of 40% while the other with a reduction of 60%. It is revealed from FIG. 5 that the stainless steel according to the invention and the control steel A or B exhibit the toughness of the same order if their hardnesses are at the same level. However, as already stated, the stainless steel according to the invention is advantageous in that it may have a low hardness at the state of having been cold worked and, in consequence it may be readily formed into various shapes by mechanical working.

Figure 6:
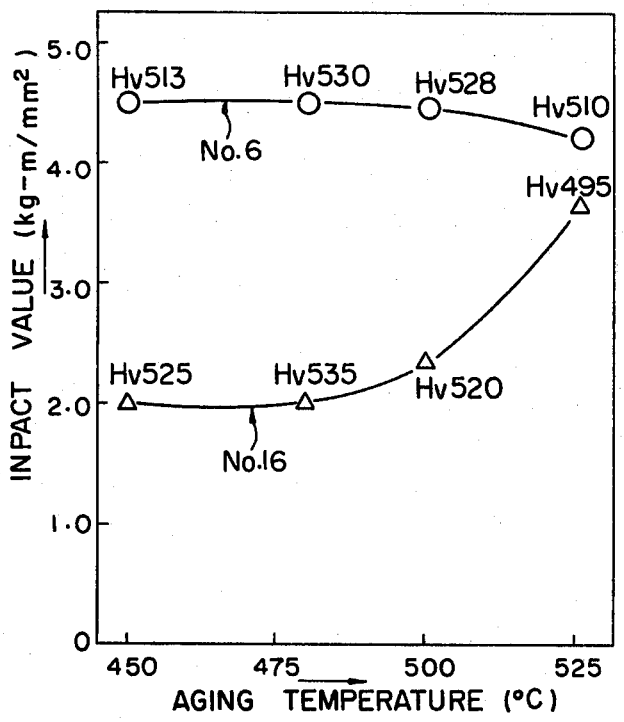
FIG. 6 is a graphical representation showing, on a steel alloy specimen according to the invention and a control steel alloy specimen, the depending of the impact value after aging upon the aging temperature.

On the steel specimens No. 6 and No. 16, having substantially the same highest attainable hardness, the impact value after aging was plotted against the aging temperature. The aging temperature was varied within the range from 450° to 525° C. The results are shown in FIG. 6. The hardness after aging Hv of each tested sample is also indicated in FIG. 6. FIG. 6 reveals that the steel specimen No. 6 according to the invention attains a higher toughness reflected by a higher impact value than the control steel specimen No. 16 does. It is further revealed from FIG. 6 that with the stainless steel according to the invention, the attained higher toughness is substantially independent upon the aging temperature ranging from 450° to 525° C. This fact means that possible variations of the processing temperature in a commercial production line do not affect the property of the product, ensuring a stable commercial production of products having a constant property. FIG. 6 shows that with the control steel the attainable toughness substantially varies depending upon the aging temperature, suggesting the necessity of a servere control of the processing temperature in a commercial production line.

Figure 7:
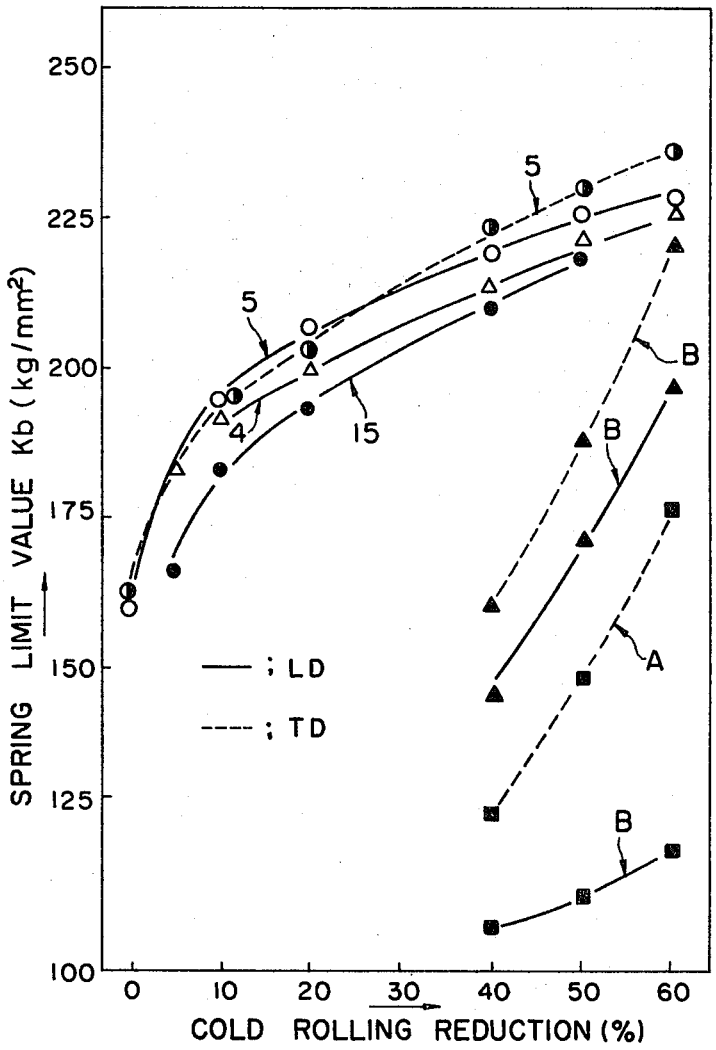
FIG. 7 is a graphical representation showing, on various steel alloy specimens, the dependency of the spring limit value after aging upon the cold rolling reduction.

On the specimens No. 4,5,15, A and B, the dependency of the spring limit value Kb upon the cold rolling reduction is graphically shown in FIG. 7. In FIG. 7, the solid lines relate to the longitudinal direction (LD), i.e. a direction of rolling, while the broken lines relate to the transverse direction (TD), i.e. a direction perpendicular to the direction of rolling. The spring limit value Kb was determined in accordance with Japanese Industrial Standard (JIS) H 3702 6.4.

As revealed from FIG. 7, the steel specimens No. 4 and 5 according to the invention always attain higher spring limit values than the control specimens do, with the cold rolling reduction being the same.

FIG. 7 further reveals that the high spring limit value attained by the invention does not greally depend upon the cold rolling reduction if the latter is in excess of about 10%. This fact means an advantageous possibility of the invention that products having various thicknesses and a desirably high spring limit value falling within a narrow range may be produce from one and the same steel strip as solution treated.

It is further revealed from FIG. 7 that the difference between the spring limit value in the transverse direction (TD), a direction perpendicular to the direction of rolling, and that in the longitudinal direction (LD), a direction parallel to the direction of rolling, is much smaller for the stainless steel according to the invention than for the conventional stainless steel (A and B). Because of the considerable difference between the TD and LD spring limit values of the conventional stainless steel, spring elements must be cut from such a material in the same direction, or otherwise the spring performance of the elements would vary from element to element. The necessity of cutting (e.g. punching) the individual elements in the same direction may appreciably reduce the yield depending upon the shape of the products. In contrast, the stainless steel according to the invention has a substantially isotropic spring performance, and therefore, does not suffer from the above-mentioned disadvantates. The isotropic spring performance according to the invention is especially advantageous in a leaf spring element punched in a complicated shape.

Figure 8:
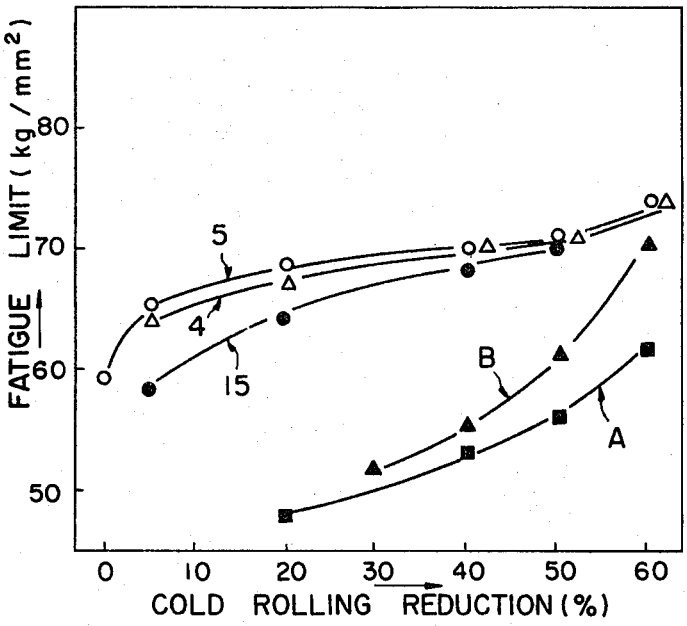
FIG. 8 is a graphical representation showing, on various steel alloy specimens, the dependency of the fatigue limit after aging upon the cold rolling reduction.

On the steel specimens No. 4,5,15, A and B, the dependency of the fatigue limit after aging upon the cold rolling reduction is shown in FIG. 8.

Figure 9:
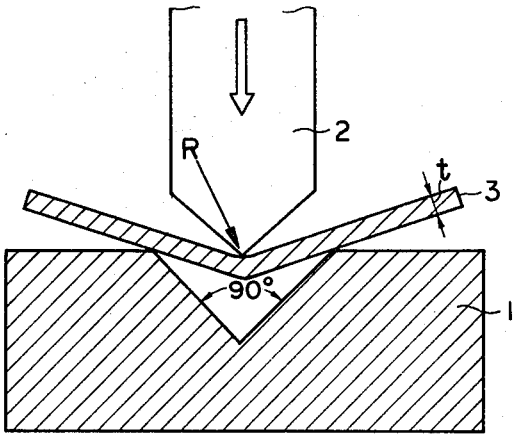
FIG. 9 is schematic view of a testing device used for testing the bending workability of steel alloy specimens.

FIG. 9 is a schematic view of a testing device used for testing the bending workability of steel alloy specimens. Using a right angle dice 1 and a punch having a tip radius of R, a test specimen 3 having a thickness of t was bent under the load of 4000 Kg. The largest tip radius R permitting the bending of the test specimen by 90° without fracture was determined, and the bending performance of the steel specimen was evaluated with the value of R/t. The lower the R/t value the better the bending performance.

Figure 10:
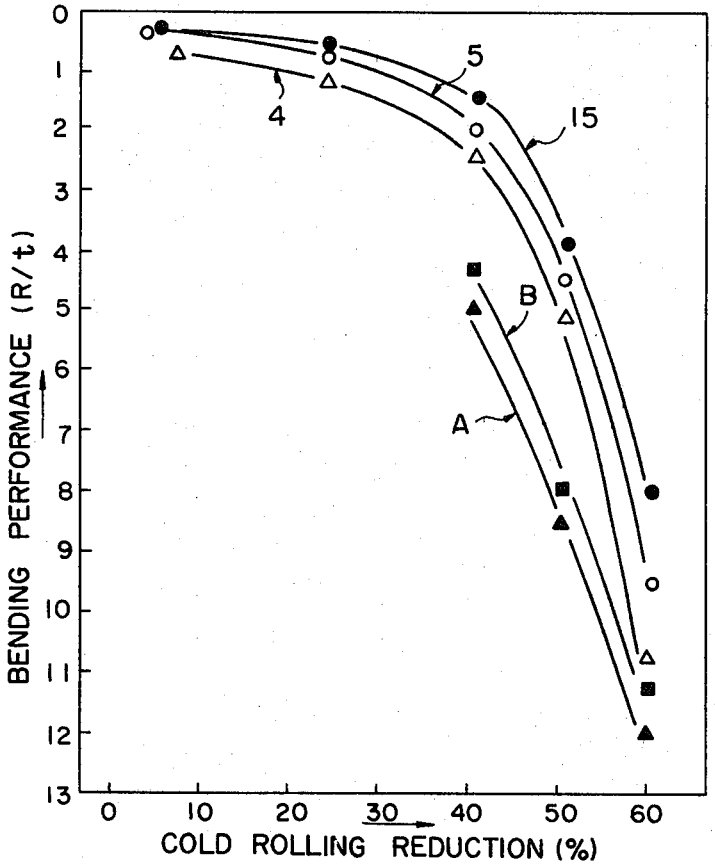
FIG. 10 is a graphical representation showing, on various steel alloy specimens, the dependency of the bending performance before aging upon the cold rolling reduction.
Figure 11:
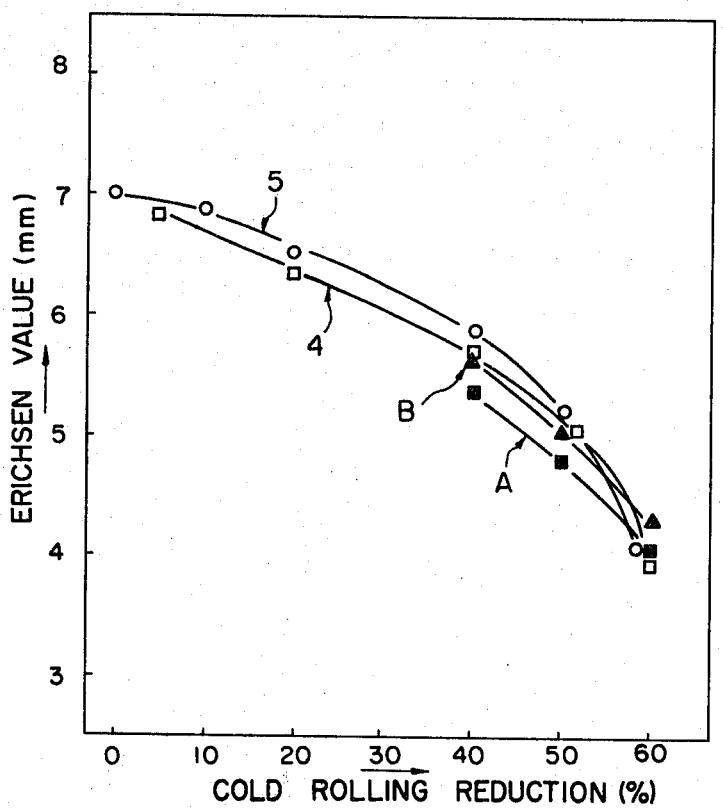
FIG. 11 is a graphical representation showing, on various steel alloy specimens, the dependency of the Erichsen value before aging upon the cold rolling reduction.

On the steel specimens No. 4,5,15, A and B, the dependency of the bending performance before aging upon the cold rolling reduction is graphically shown in FIG. 10. FIG. 10 reveals that the specimens No. 4,5 and 15 exhibit a bending performance before aging superior to that of the specimens A and B. The specimen No. 15 according to Japanese Patent Application No. 51-131610 has the best bending performance before aging. This is because as already stated, Japanese Patent Application No. 51-131610 makes much account of the mechanical workability before aging and the present invention primarily aims an improved toughness and spring performance after aging while retaining a satisfactory mechanical workability before aging.

It is further revealed from FIG. 10 that the bending performance before aging of the precipitation hardening type stainless steel becomes poor as the cold rolling reduction exceeds 50%. For this very reason, we have restricted the cold rolling reduction to a level of up to 50%.

As already stated, it is widely practiced to form a thin material for spring into various shapes of a small size by bulging and/or drawing thereby to manufacture a miniaturized spring element whose reduced durability and strength are compensated by its shape. On the specimens No. 4,5, A and B, the bulging formability before aging was tested in accordance with the Erichsen test prescribed in JIS B. The dependency of the Erichsen value upon the cold rolling reduction is shown in FIG. 10 for each tested steel specimen. In consideration of the fact that the cold working of the material as solution treated, if any, should be carried with a relatively low rolling reduction of up to 50% in the practice of the invention while the conventional steel A or B requires an intensive cold working with a rolling reduction of in excess of 40% in order to achieve a desired level of the strength after aging, FIG. 10 reveals that a better bulging workability is readily attainable in accordance with the invention.

As demonstrated hereinabove, the stainless steel in accordance with the invention exhibits an enhanced mechanical workability, including good forming and punching workabilities, before aging, and when age hardened, develops not only a desirably high hardness and toughness but also an improved and isotropic spring performance. While the stainless steel in accordance with the invention is especially useful for the manufacture of leaf spring elements having complicated shapes and of punched spring elements of high strength and toughness, it is also suitable for the production of other spring elements.

What is claimed is:

1. A precipitation hardening type stainless steel for spring comprising in % by weight more than 0.03% but not more than 0.08% of C, 0.3 to 2.5% of Si, not more than 4.0% of Mn, 5.0 to 9.0% of Ni, 12.0 to 17.0% of Cr, 0.1 to 2.5% of Cu, 0.2 to 1.0% of Ti and not more than 1.0% of Al, the balance being Fe and unavoidable impurities, the contents of the elements being further adjusted so that the A' value defined by the equation $$A' = 17\times(C\%/Ti\%)+0.70\times(Mn\%)+1\times(Ni\%)+0.60\times(Cr\%)+0.76\times(Cu\%)-0.63\times(Al\%)+20.871$$

is less than 42.0, the ratio of Cr equivalents to Ni equivalents defined by the equation $$\frac{\text{Cr equivalents}}{\text{Ni equivalents}} = \frac{1\times(Cr\,\%)+3.5\times(Ti\,\%+Al\,\%)+1.5\times(Si\,\%)}{1\times(Ni\,\%)+0.3\times(Cu\,\%)+0.65\times(Mn\,\%)}$$

is not more than 2.7, and ΔHv value defined by the equation $$\Delta Hv = 205\times[Ti\%-3\times(C\%+N\%)]+205\times[Al\%-2\times(N\%)]+57.5\times(Si\%)+20.5\times(Cu\%)+20$$

is within the range between 120 and 210, said steel having a substantial martensitic structure at the state of having been solution treated or at the state of having been solution treated and then cold worked with a rolling reduction of not more than 50%.

2. The stainless steel for spring in accordance with claim 1 characterized in that said steel has a Vickers hardness of not more than Hv 380 before being age hardened and that said steel has a Charpy impact value of at least 3 Kg-m/cm$^2$ and a Vickers hardness of at least Hv 490 after being age hardened.

* * * * *